US009863094B2

(12) United States Patent
Pang et al.

(10) Patent No.: US 9,863,094 B2
(45) **Date of Patent: *Jan. 9, 2018**

(54) PRINTABLE COMPOSTABLE PAPERBOARD

(71) Applicant: WestRock MWV, LLC, Norcross, GA (US)

(72) Inventors: Jiebin Pang, Glen Allen, VA (US); Natasha G. Melton, Richmond, VA (US); Steven Parker, Raleigh, NC (US)

(73) Assignee: WestRock MWV, LLC, Norcross, GA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/258,181

(22) Filed: Sep. 7, 2016

(65) Prior Publication Data

US 2017/0002517 A1 Jan. 5, 2017

Related U.S. Application Data

(63) Continuation-in-part of application No. 15/230,896, filed on Aug. 8, 2016, now Pat. No. 9,670,621, which is a continuation-in-part of application No. 15/017,735, filed on Feb. 8, 2016, now Pat. No. 9,771,688.

(60) Provisional application No. 62/372,403, filed on Aug. 9, 2016, provisional application No. 62/164,128, filed on May 20, 2015, provisional application No. 62/114,716, filed on Feb. 11, 2015.

(51) Int. Cl.

| | |
|---|---|
| ***D21H 21/14*** | (2006.01) |
| ***D21H 19/40*** | (2006.01) |
| ***D21H 19/38*** | (2006.01) |
| ***D21H 27/22*** | (2006.01) |
| ***D21H 27/10*** | (2006.01) |
| ***D21H 23/48*** | (2006.01) |
| ***D21H 23/50*** | (2006.01) |
| ***D21H 23/56*** | (2006.01) |
| ***D21H 23/72*** | (2006.01) |
| ***D21H 19/44*** | (2006.01) |
| ***D21H 19/58*** | (2006.01) |
| ***D21H 19/60*** | (2006.01) |
| ***D21H 19/82*** | (2006.01) |
| ***D21H 21/16*** | (2006.01) |
| ***D21H 23/32*** | (2006.01) |
| ***D21H 23/34*** | (2006.01) |

(52) U.S. Cl.

CPC ..... *D21H 21/14* (2013.01); *D21H 19/38* (2013.01); *D21H 19/385* (2013.01); *D21H 19/40* (2013.01); *D21H 19/44* (2013.01); *D21H 19/58* (2013.01); *D21H 19/60* (2013.01); *D21H 19/82* (2013.01); *D21H 19/822* (2013.01); *D21H 21/16* (2013.01); *D21H 23/32* (2013.01); *D21H 23/34* (2013.01); *D21H 23/48* (2013.01); *D21H 23/50* (2013.01); *D21H 23/56* (2013.01); *D21H 23/72* (2013.01); *D21H 27/10* (2013.01); *D21H 27/22* (2013.01)

(58) Field of Classification Search

CPC ..... D21H 21/14; D21H 19/38; D21H 19/385; D21H 19/40; D21H 19/44; D21H 19/58; D21H 19/60; D21H 19/82; D21H 19/822; D21H 21/16; D21H 23/32; D21H 23/34; D21H 23/48; D21H 23/50; D21H 23/56; D21H 23/72; D21H 27/10; D21H 27/22

USPC ..... 428/537.5

See application file for complete search history.

(56) References Cited

U.S. PATENT DOCUMENTS

| | | | | | |
|---|---|---|---|---|---|
| 5,776,619 | A * | 7/1998 | Shanton | A47G 19/03 | 427/326 |
| 5,981,011 | A * | 11/1999 | Overcash | D21H 19/16 | 428/34.2 |
| 6,074,733 | A * | 6/2000 | Falat | B65D 65/42 | 428/219 |
| 6,740,373 | B1 * | 5/2004 | Swoboda | B32B 29/06 | 229/5.81 |
| 7,404,999 | B2 | 7/2008 | Wilhoit et al. | | |
| 7,833,915 | B2 | 11/2010 | Propst | | |
| 8,597,733 | B2 | 12/2013 | Vonfelden | | |
| 2004/0121080 | A1 * | 6/2004 | Urscheler | B05D 1/305 | 427/420 |
| 2011/0262745 | A1 | 10/2011 | Ronka | | |
| 2013/0330527 | A1 | 12/2013 | Hartmann et al. | | |
| 2014/0113152 | A1 | 4/2014 | Zischka et al. | | |
| 2014/0120277 | A1 | 5/2014 | Vonfelden | | |
| 2014/0272352 | A1 | 9/2014 | Tilton | | |

FOREIGN PATENT DOCUMENTS

| | | | |
|---|---|---|---|
| EP | 0718437 | A1 | 9/2003 |
| EP | 1940561 | A1 | 7/2008 |
| EP | 2719825 | A1 | 4/2014 |
| WO | WO2006/007239 | * | 1/2006 |

(Continued)

OTHER PUBLICATIONS

International Search Report and Written Opinion for PCT/US2016/017463, dated May 10, 2016.

*Primary Examiner* — Leszek Kiliman

(74) *Attorney, Agent, or Firm* — WestRock Intellectual Property Group

(57) ABSTRACT

A coated paperboard is disclosed which includes a barrier coating containing substantially no fluorochemical or wax, exhibiting good resistance to oil and grease, no tendency toward blocking, the coated paperboard being fully repulpable as well as compostable. The coated paperboard may further have a printable coating on a surface opposite from the barrier coating.

19 Claims, 7 Drawing Sheets

(56) References Cited

FOREIGN PATENT DOCUMENTS

| | | | | |
|---|---|---|---|---|
| WO | WO2006007239 | A2 | | 1/2006 |
| WO | WO2009142731 | A1 | | 11/2009 |
| WO | WO2010042162 | A1 | | 4/2010 |
| WO | WO2013/189550 | | * | 12/2013 |
| WO | WO2013189550 | A1 | | 12/2013 |
| WO | WO2014/006269 | | * | 1/2014 |
| WO | WO2014006269 | A1 | | 1/2014 |
| WO | WO2015003275 | A1 | | 1/2015 |

* cited by examiner

PRINTABLE COMPOSTABLE PAPERBOARD

REFERENCE TO RELATED APPLICATIONS

This application is a continuation in part of U.S. application Ser. No. 15/230,896 filed on Aug. 8, 2016, which is a continuation in part of U.S. application Ser. No. 15/017,735 filed on Feb. 8, 2016, which claims the benefit of priority under 35 U.S.C. §119(e) of U.S. provisional application Ser. No. 62/114,716 filed on Feb. 11, 2015, and Ser. No. 62/164,128 filed on May 20, 2015, all of which are incorporated herein by reference in their respective entireties. This application also claims the benefit of priority under 35 U.S.C. §119(e) of U.S. provisional application Ser. No. 62/372,403 filed on Aug. 9, 2016 which is incorporated herein by reference in its entirety.

BACKGROUND OF THE INVENTION

Field of Invention

This disclosure relates to paperboard substrates having oil and grease resistance, yet with full recyclability and without having a tendency toward blocking, and furthermore being compostable.

Description of the Related Art

Sustainable packages using renewable, recyclable, and/or compostable materials are increasingly and strongly desired for food service and food packaging. Paper or paperboard itself is one of the most sustainable materials for packaging applications; however, paper or paperboard is often coated or laminated with barrier materials to fulfill the requirements of packaging. These additional barrier coatings or films often make the finished packages no longer repulpable or compostable. For example, widely used polyethylene coated paperboard is neither compostable nor recyclable under typical conditions. Polylactide coated paperboard can be compostable under industrial conditions, but it is not recyclable.

Oil and grease resistance is one of the top needs for paperboard packages in food and food service industries. Several technologies including specialty chemical (wax, fluorochemicals, starch, polyvinyl alcohol (PVOH), sodium alginate, etc.) treatment, polymer extrusion coating (polyethylene, etc.) have been employed to provide oil and grease resistance of paperboard packaging. However, the paper or paperboard treated with wax or coated with polyethylene, which is currently used in oil and grease resistant packaging, has difficulties in repulping and is not as easily recyclable as conventional paper or paperboard. Paper or paperboard treated with specialty chemicals such as fluorochemicals has potential health, safety and environmental concerns, and scientists have called for a stop to non-essential use of fluorochemicals in common consumer products including packaging materials.

There is a need for oil and grease resistant paperboard that is recyclable, compostable, low cost, and without environmental or safety concerns. Aqueous coating is one of the promising solutions to achieve these goals. However, blocking (the tendency of layers in a roll of paperboard to stick to one another) is a challenging technical hurdle in production and converting processes for aqueous barrier coated paperboard, and blocking is also a major technical hurdle for on-machine application of aqueous barrier coatings. Furthermore, most aqueous barrier coatings are not fully repulpable. Commonly-assigned U.S. application Ser. No. 15/017,735 which is incorporated herein by reference, addresses these problems. However, it is further desired to have a paperboard that is compostable. The ASTM D6868-11 Standard Specification for compostability of paper or paperboard requires any non-biodegradable organic constituent to be <1% of the dry weight of the finished product, and the total portion of organic constituents that are not biodegradable cannot exceed 5% of the total weight. Most conventional or commercially available aqueous barrier coatings use high to pure synthetic polymer binder level, which makes it extremely challenging to meet this <1% non-biodegradable composition requirement for the ASTM compostability standard, while achieving the barrier performance required by the package.

SUMMARY OF THE INVENTION

In the present work, certain inventive coatings that have barrier properties have achieved the ASTM compostability standard, at least for paperboard that is 12 caliper (0.012") or higher. With lower caliper paperboards, the coating(s) typically contribute a larger share of the total weight, with the result that the non-biodegradable organic constituent in the coatings becomes more than 1% of such lower-caliper paperboard.

The general purpose of the invention is to coat the 'barrier' side of a paperboard with at least one layer of aqueous coating containing a renewable natural material (modified starch) and a specialty synthetic binder, resulting in the coated oil and grease resistant paperboard (i.e., 12 pt caliper and above) meeting the <1% non-biodegradable composition requirement for the compostability standard. The coating can either be applied on a paper machine or by an off-line coater, and can be applied in two coating steps (or two passes) for further enhanced barrier properties. Paperboard coated according to the invention provides resistance to oil and grease, does not have any tendency to block, is compliant to safety and environmental regulations, is fully repulpable, is compostable, and can be produced at a low cost.

In one embodiment a coated paperboard is disclosed which includes a paperboard substrate having a first side and a second side; a first coating in contact with the first side, the first coating having a coat weight from 5 to 12 lbs per 3000 ft2 and comprising binder and pigment, the first coating containing substantially no fluorochemical or wax; a second coating in contact with the second side, wherein the second coating is a printable coating; wherein the coated paperboard has a caliper of at least 0.010"; wherein the coated paperboard provides barrier properties to at least one of oil, grease, and moisture; wherein the coated paperboard is compostable according to the ASTM D6868-11 standard for compostability; and wherein the coated paperboard is at least 99% repulpable.

In one embodiment a method of treating paperboard is disclosed, the method including providing a paperboard substrate having a first side and a second side; applying to the first side a coating comprising binder and pigment, and containing substantially no fluorochemical or wax; applying to the second side a printable coating; wherein the binder comprises starch; wherein the treated paperboard has a caliper of at least 0.010"; wherein the treated paperboard is compostable according to the ASTM D6868-11 standard for compostability; wherein the treated paperboard has a 3M kit test value of at least 3; and wherein the treated paperboard is repulpable to the extent that after repulping the percentage accepts is at least 99%.

In one embodiment, a coated paperboard is disclosed which includes a paperboard substrate; a base coating in contact with the paperboard substrate, the base coating having a coat weight from 6 to 10 lbs per 3000 ft2 and comprising binder and pigment; a top coating in contact with the base coating, the top coating having a coat weight from 4 to 7 lbs per 3000 ft2 and comprising binder and pigment; wherein the coated paperboard has a caliper of at least 0.010"; and wherein the coated paperboard is compostable according to the ASTM D6868-11 standard for compostability.

DETAILED DESCRIPTION OF THE INVENTION

Figure 1:
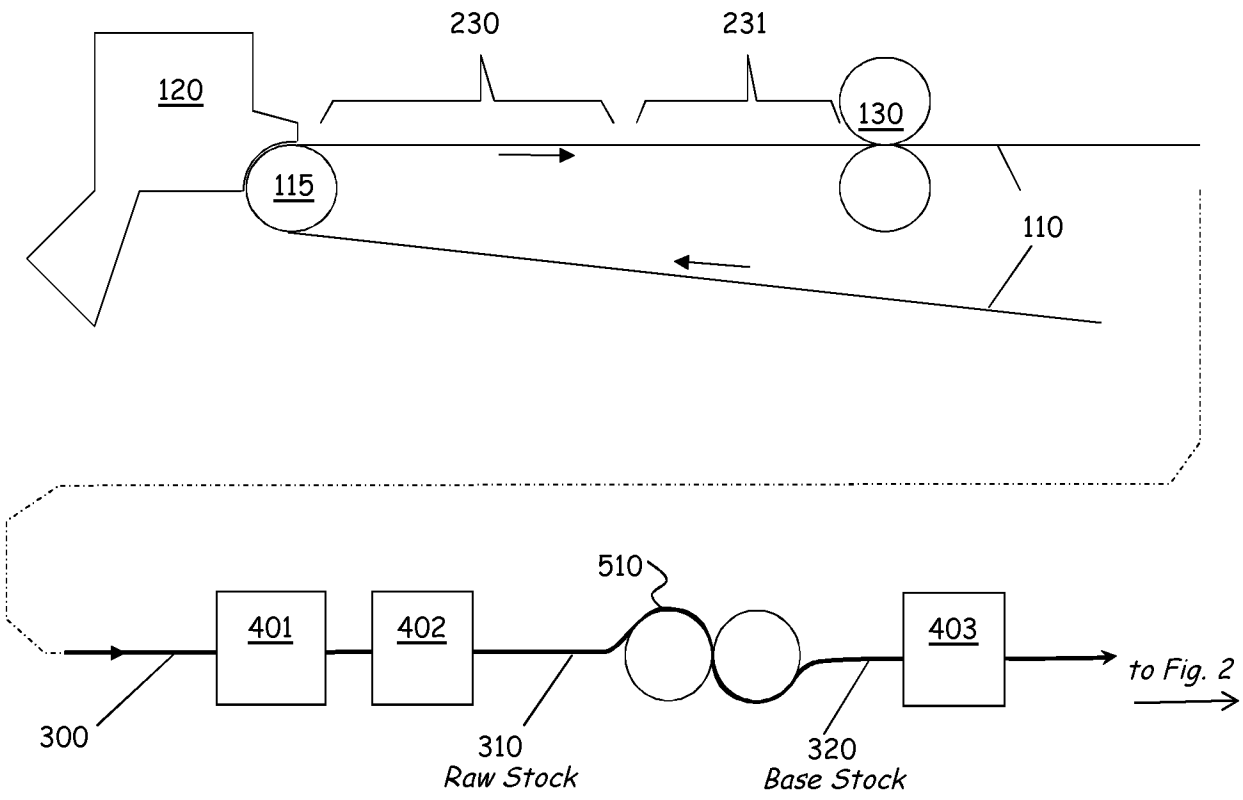
FIG. 1 illustrates a method for producing a base stock on a paperboard machine.
Figure 2:
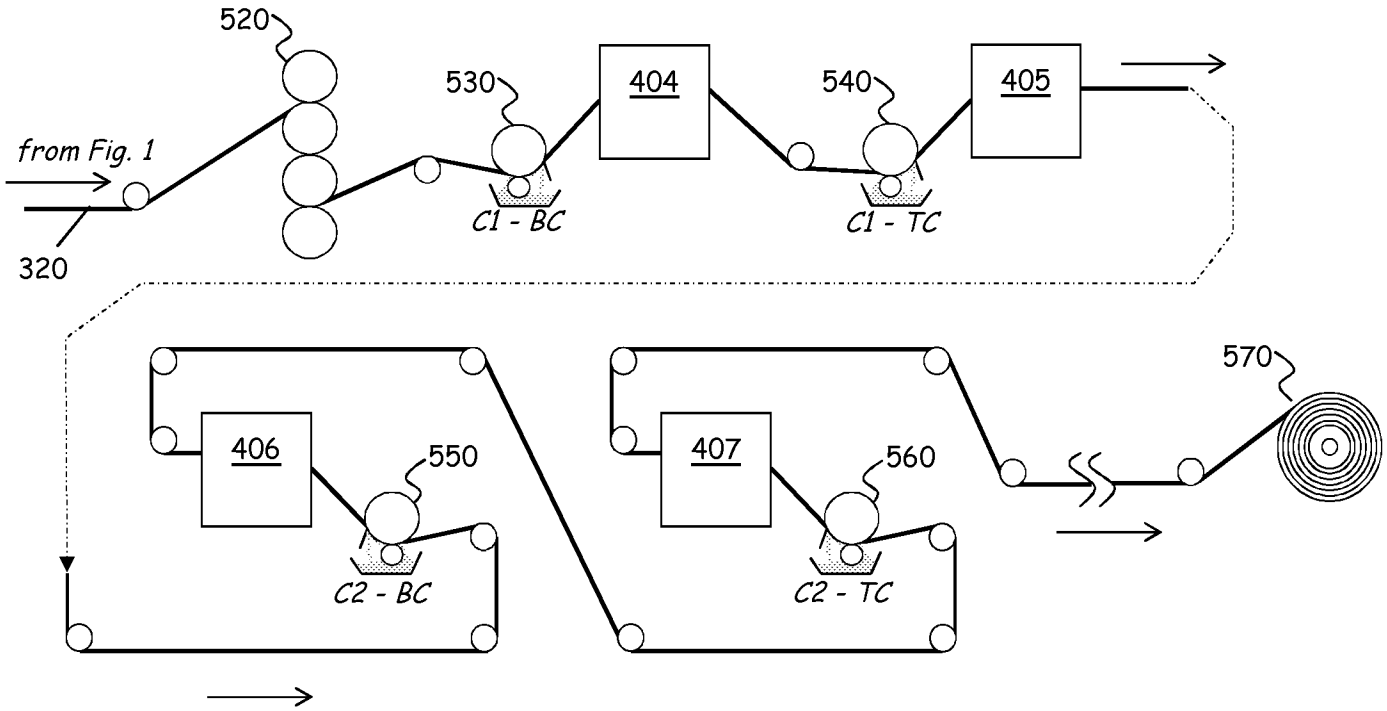
FIG. 2 illustrates a method for treating the base stock from FIG. 1 by applying coatings to both sides on a paperboard machine.

FIG. 1 and FIG. 2 illustrate an exemplary on-paper machine method for coating a paperboard web with one or more layers of aqueous coating. A forming wire 110 in the form of an endless belt passes over a breast roll 115 that rotates proximate to a headbox 120. The headbox provides a fiber slurry in water with a fairly low consistency (for example, about 0.5% solids) that passes onto the moving forming wire 110. During a first distance 230 water drains from the slurry and through the forming wire 110, forming a web 300 of wet fibers. The slurry during distance 130 may yet have a wet appearance as there is free water on its surface. At some point as drainage continues the free water may disappear from the surface, and over distance 231, water may continue to drain although the surface appears free from water.

Eventually the web is carried by a transfer felt or press felt through one or more pressing devices such as press rolls 130 that help to further dewatering the web, usually with the application of pressure, vacuum, and sometimes heat. After pressing, the still relatively wet web 300 is dried, for example using dryer or drying sections 401, 402 to produce a dry web ("raw stock") 310 which may then be run through a size press 510 that applies a surface sizing to produce a sized "base stock" 320 which may then be run through additional dryer sections 403 and (on FIG. 2) smoothing steps such as calendar 520.

The base stock 320 may then be run through one or more coaters. For example, coater 530 may apply a first coat ("BC") to a first side ("C1") of the web, and the first coat may be dried in one or more dryer sections 404. Coater 540 may apply a second coat ("TC") to the first side of the web, and the second coat may be dried in one or more dryer sections 405.

Figure 3:
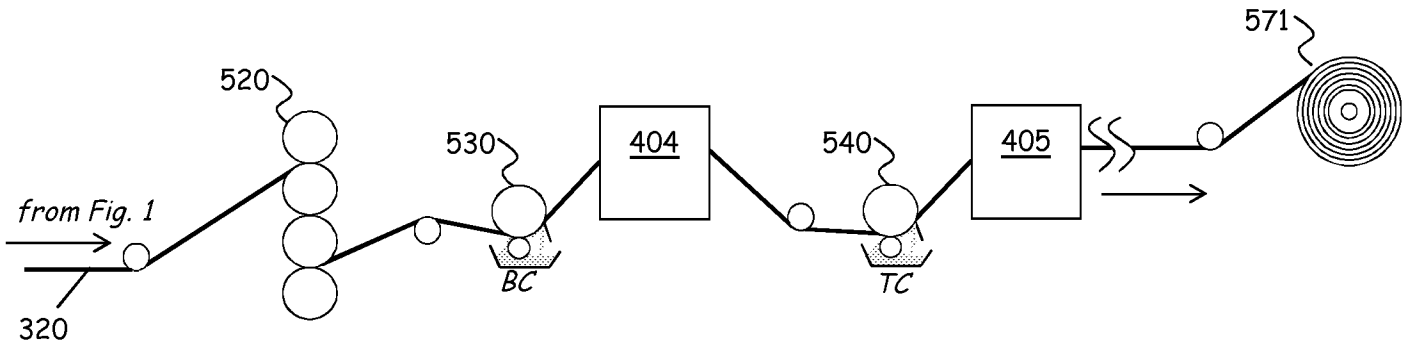
FIG. 3 illustrates a method for treating the base stock from FIG. 1 by applying coatings to one side on a paperboard machine.

If the web is to be coated on two sides, coater 550 may apply a first coat to the second side ("C2") of the web, and this coat may be dried in one or more dryer sections 406. Coater 560 may apply a second coat to the second side of the web, and this coat may be dried in one or more dryer sections 407. The order of coaters 540, 550 may be swapped, so that both sides C1 and C2 are first given a first coat, and then one side or both sides are given a second coat. In some instances only one side will be coated as shown in FIG. 3, or only a first coat may be applied. In some instances a third coat may be applied to one side.

Figure 4:
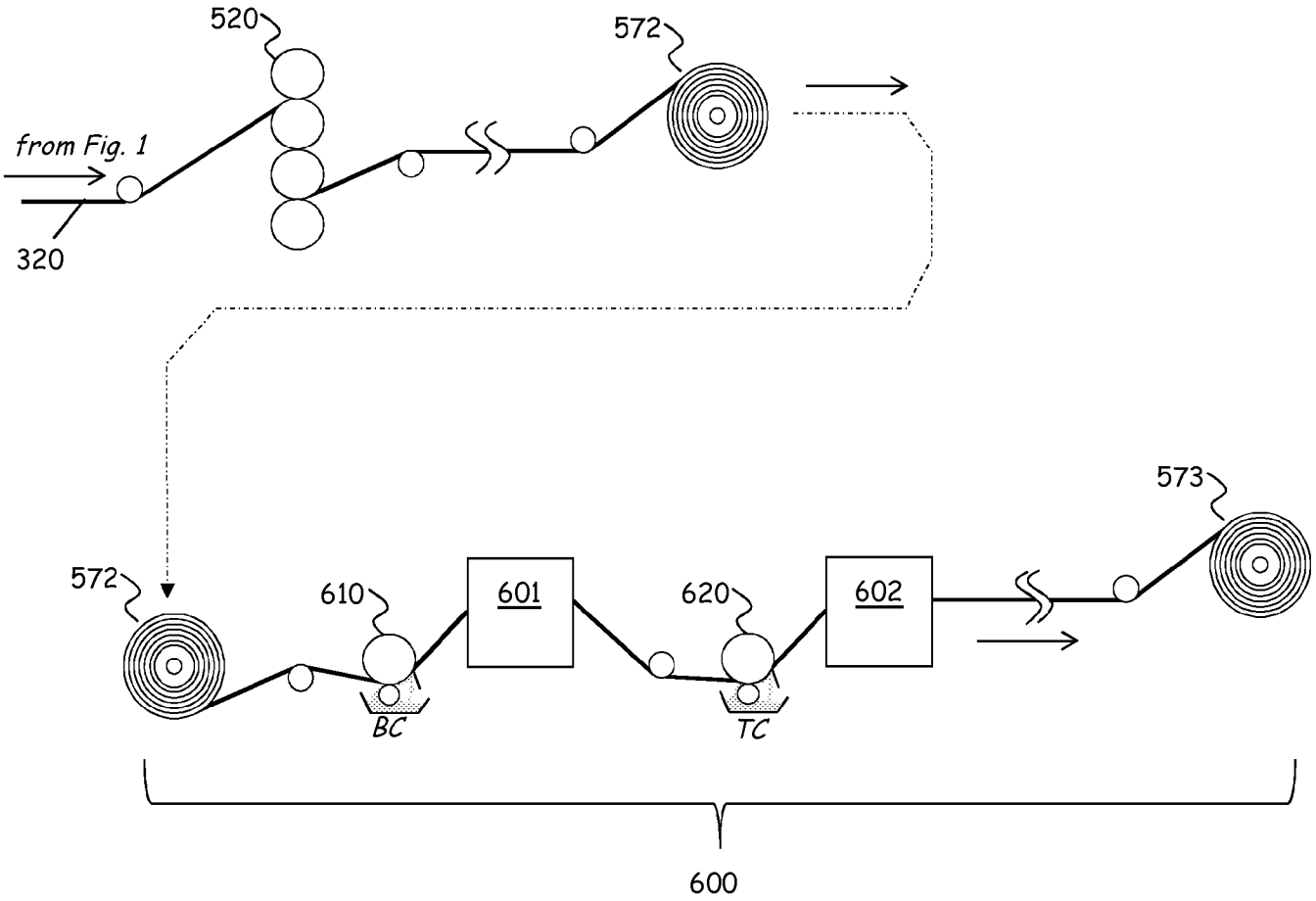
FIG. 4 illustrates a method for treating the base stock from FIG. 1 by applying coatings to one side on an off-machine coater.

Instead of applying coating by on-machine coaters as shown in FIGS. 2 and 3, coating may be applied by an off-machine coater as shown in FIG. 4. In such cases, the paperboard having been produced on the paper machine and wound onto reel 572 may then be transported (as a reel or as smaller rolls) to an off machine coater 600, where the paperboard is unwound from reel 572, given a first coating by coater 610, dried in dryer(s) 601, given an optional second coating by coater 620, dried in dryer(s) 602, optionally given further treatment (such as gloss calendaring) and then wound onto reel 573. An off machine coater could instead apply a single coat to one side of the paperboard, or could apply a single coat to each side, or could apply more than one coat to either or both sides. Alternately some coating may be done on the paper machine, with additional coating done on an off-machine coater.

Various types of coating devices may be used. The coaters illustrated in FIGS. 2-4 are devices where a coating is held in a pan, transferred by a roll to the lower surface of the web (which may be either the first side or the second side depending on the web path), and then the excess coating scraped off by a blade as the web wraps partially around a backing roll. However other coater types may be used instead, including but not limited to curtain coater, air knife coater, rod coater, film coater, short-dwell coater, spray coater, and metering film size press.

The particular materials used in the coatings may be selected according to the desired properties of the finished paperboard. For example one side e.g. C1 may be given coating(s) that provide desired printability, while the other side e.g. C2 may be given barrier coating(s) that provide oil and grease resistance (OGR). The printability coating may be applied before the OGR coating, or, the OGR coating may be applied before the printability coating.

Following the coaters, there may be additional equipment for further processing such as additional smoothening, for example gloss calendaring. Finally, the web is tightly wound onto a reel 570.

The general process of papermaking and coating having been outlined at a high level in the preceding description and with FIGS. 1-4, we now turn to the coatings of the present invention. Typical aqueous barrier coatings often use specialty polymer(s), wax, and/or a higher polymer binder level (compared to conventional print coatings). These coatings can cause problems with repulpability of the coated paperboard because the coatings are usually difficult to breakdown to acceptable size or tend to form 'stickies' in paperboard making with the recycled fibers. Due to the high content of synthetic polymer binder in the coating, it is extremely challenging for each of the individual organic components in the coating to meet the <1% non-biodegradable composition requirement of the ASTM D6868-11 compostability standard.

Furthermore, many barrier coatings give paperboard a tendency to 'block' (the layers stick together) either in the reel 570, 571, 572, 573 or after it is rewound into rolls.

Particularly in the reel 570, there may be residual heat from the dryers, which may dissipate quite slowly because of the large mass of the reel. Higher temperatures may increase the tendency toward blocking.

It is known that paperboard coated with conventional printability coatings usually does not block, and usually is fully repulpable. It would be advantageous if non-blocking and fully repulpable coatings also provided at least some degree of barrier properties. However, conventional printability coatings do not provide satisfactory barrier properties. Their formulations have relatively low levels of binder so as to absorb rather than repel fluid (printing ink, for example).

Binder amounts in conventional printability coatings can range from 15-25 parts per 100 parts of pigment by weight for base coatings, and 10-20 parts per 100 parts pigment by weight for top coatings. Printing grades would tend to be in the lower half of these ranges. Limiting the binder amount in the top coating may allow printing inks or adhesives to absorb readily into the printability coating. Simply increasing the binder to improve barrier properties eventually interferes with printability and causes additional problems, including blocking and repulpability problems.

Similar blocking and repulpability problems exist with many aqueous barrier coatings that use specialty polymer(s) and/or a higher polymer binder level (compared to printability coatings), with the deleterious effect that the coated paperboard is not completely recyclable and tends to block at elevated temperature or pressure.

In contrast, the inventive coatings disclosed in the present application provide easy repulping, meet the composition requirement for the ASTM compostability standard, do not block at elevated temperature and pressure, and show good barrier properties, while using conventional pigments and synthetic and natural binders that are low-cost and readily available as coating materials for the paper or paperboard industry.

Conventional pigments are used in the present invention and may include, but are not limited to, kaolin clay, calcium carbonate, etc. Pigments used in the examples herein are given the following 'shorthand' designations:

"Clay-1" kaolin clay, for example, a No. 1 ultrafine clay

"Clay-2" platy clay with high aspect ratio

"CaCO3-1" coarse ground calcium carbonate (particle size 60%<2 micron)

"CaCO3-2" fine ground calcium carbonate (particle size 90%<2 micron)

Synthetic polymer binders may include, but are not limited to, styrene acrylate copolymer (SA), polyvinyl acetate (PVAc), and styrene-butadiene copolymer (SB), etc. Natural binders may include, but are not limited to, starch, alginate, protein, etc. Conventional styrene acrylate binder (SA, PHOPLEX® C-340, available from Dow Chemical Company), acrylic polymer binder (Basonal® X400AL, available from BASF Corporation), starch binder (Pen-Cote® D UHV, available from Ingredion Incorporated), or a blend of Pen-Cote® D with SA or Basonal®, are used in examples described herein. Benefits of using Pen-Cote® D include its being directly dispersible into the formulation, increasing the coating formulation solids, and possibly being able to eliminate other thickeners. The choice of binder in the examples is not meant to be limiting in any way.

Coatings including control coatings in the present invention were prepared according to the formulations shown in Table 1, which provides a list of major constituents in dry parts of the aqueous coating (C—Control, CF—Compostable Formulation) formulations used to achieve the oil and grease resistance, and to meet the composition requirement for the ASTM compostability standard, without blocking or repulpability problems. The test results are shown in Tables 3 and 4.

Substantially no fluorochemical was used in the coatings. By "substantially no fluorochemical" is meant that fluorochemicals were not deliberately utilized, and that any amount present would have been at most trace amounts. Although fluorochemicals can be excluded in lab experiments, trace amounts of such materials might be present in some paper machine systems due to making various grades of product, or might be introduced into a papermaking system through recycling processes. Likewise substantially no wax was used in the coatings.

The total binder to pigment ratio (parts of binder, by weight, to 100 parts of pigment) of the formulations shown in Table 1 ranges from 30 to 35. This is more than the binder to pigment ratio for typical printability coatings (where rapid absorption of ink is desired) and less than the binder to pigment ratio of typical barrier coatings. Thus it appears that an effective binder to pigment ratio may be from about 25 to about 40 parts binder per 100 parts pigment (by weight), or from 30 to 35 parts binder per 100 parts pigment. However, perhaps acceptable results (good 3M kit test, no blocking, and good repulpability) might be achieved with a slightly greater range. Blending starch (such as Pen-Cote® D), a natural biodegradable material, into the formulation helps meet the <1% non-biodegradable composition requirement for the ASTM compostability standard while maintaining the barrier performance. The Pen-Cote® D starch was added at up to 5 parts in the final formulations.

Paperboard samples were made using solid bleached sulphate (SBS) substrate with a caliper of 18 pt (0.018"). The samples were coated on one side (herein termed the "barrier side") using a pilot blade coater with a one-layer coating. The pilot results are expected to be representative of results that might be achieved on a production paper machine or a production off-machine coater.

The oil and grease resistance (OGR) of the samples was measured on the 'barrier side' by the 3M kit test (TAPPI Standard T559 cm-02). With this test, ratings are from 1 (the least resistance to oil and grease) to 12 (excellent resistance to oil and grease penetration). The results here gave 3M kit levels between 1 to 6 (see Table 3). The higher values were obtained with the higher coat weights for each specific formulation. Most interestingly, it is found that Basonal® binder itself (C2 formulation) performs better on 3M kit level than SA binder (C1 formulation) at comparable coat weights (see Table 3); furthermore, blending Pen-Cote® D starch with Basonal® (CF1-3) maintains the performance on 3M kit level as using Basonal® itself at comparable or slightly higher coat weight, while meeting the <1% non-biodegradable composition requirement for the ASTM compostability standard. Especially, a 3M kit level of 4-5 (suitable for most food service packages) is achieved while meeting the compostability standard.

In addition to 3M kit test, oil absorptiveness (oil Cobb) was used to quantify and compare the OGR performance (oil and grease resistance), which measures the mass of oil absorbed in a specific time, e.g., 30 minutes, by 1 square meter of coated paperboard. For each condition tested, the sample was cut to provide two pieces each 6 inch×6 inch square. Each square sample was weighed just before the test. Then a 4 inch×4 inch (area of 16 square inches or 0.0103 square meters) square of blotting paper saturated with peanut oil was put on the center of the test specimen (barrier side) and pressed gently to make sure the full area of oily blotting paper was contacting the coated surface. After 30-minutes as monitored by a stop watch, the oily blotting paper was gently removed using tweezers, and the excess amount of oil was wiped off from the coated surface using paper wipes (Kimwipes™). Then the test specimen was weighed again. The weight difference in grams before and after testing divided by the test area of 0.0103 square meters gave the oil Cobb value in grams/square meter.

As the oil Cobb results shown in Table 3, all the formulations (CF1-4) containing Basonal® and Pen-Cote® D starch showed similar or improved (lower) oil Cobb value compared to both control formulations (C1 or C2), while all of them met the ASTM compostability standard. This confirmed the 3M kit results; and most interestingly, although CF4 at a coat weight 11.3 lb/3 msf showed a 3M kit level of 3.8, it performed very well on actual oil holdout showing an oil Cobb of 4.9 gsm in 30 minutes (Table 3)

Moisture resistance of the coatings was evaluated by WVTR (water vapor transmission rate at 38° C. and 90% relative humidity; TAPPI Standard T464 OM-12) and water Cobb (TAPPI Standard T441 om-04). All the formulations (CF1-4, Table 3) containing Basonal® and Pen-Cote® D starch showed similar water Cobb and WVTR values compared to both control formulations (C1 or C2), while all of them met the ASTM compostability standard.

Figure 5:
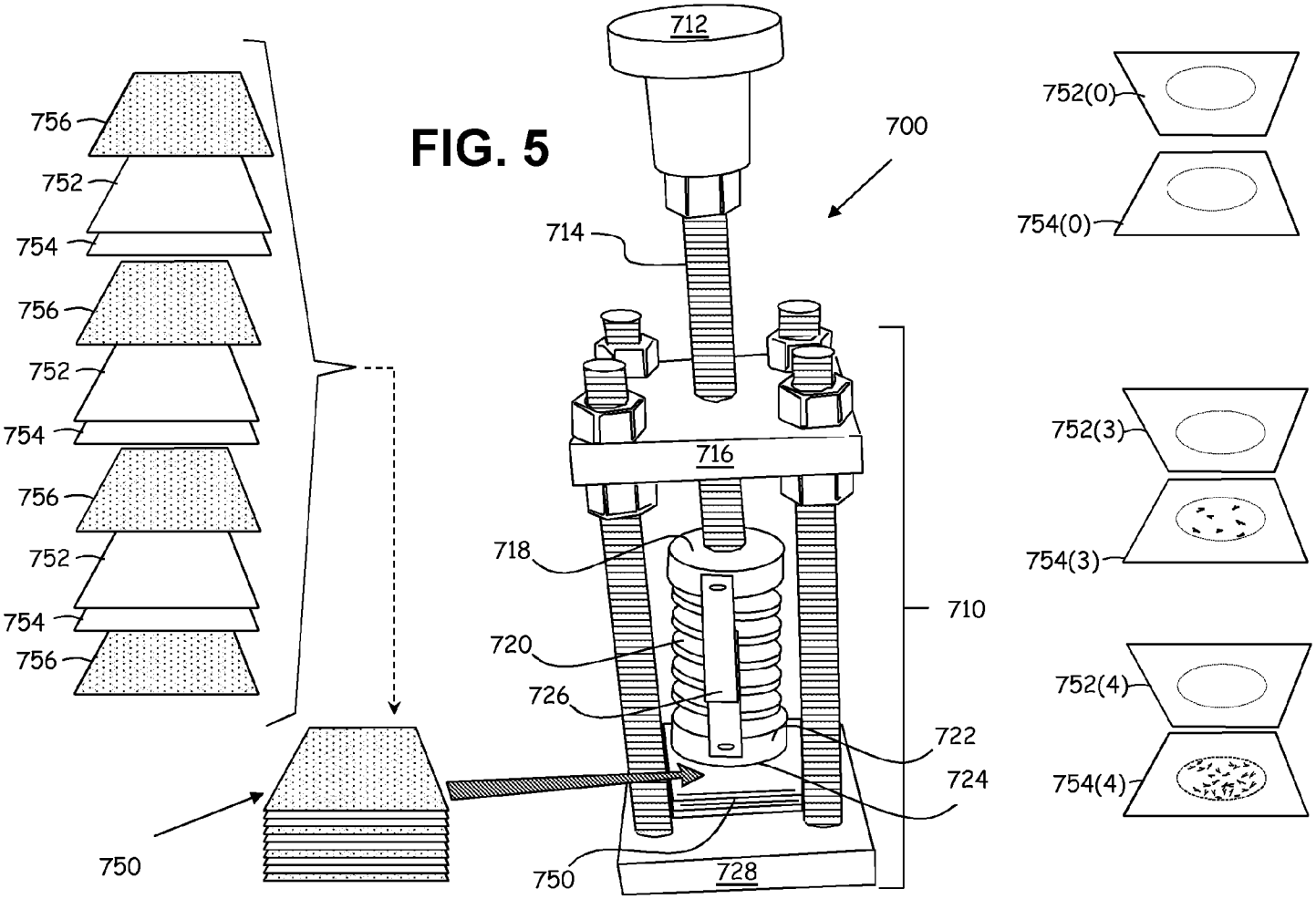
FIG. 5 illustrates a device for measuring blocking of paperboard.

The blocking behaviour of the samples was tested by evaluating the adhesion between the barrier coated side and the other uncoated side. A simplified illustration of the blocking test is shown in FIG. 5. The paperboard was cut into 2"×2" square samples. Several duplicates were tested for each condition, with each duplicate evaluating the blocking between a pair of samples 752, 754. (For example, if four duplicates were test, four pairs—eight pieces—would be used.) Each pair was positioned with the 'barrier-coated' side of one piece 752 contacting the uncoated side of the other piece 754. The pairs were placed into a stack 750 with a spacer 756 between adjacent pairs, the spacer being foil, release paper, or even copy paper. The entire sample stack was placed into the test device 700 illustrated in FIG. 5.

The test device 700 includes a frame 710. An adjustment knob 712 is attached to a screw 714 which is threaded through the frame top 716. The lower end of screw 714 is attached to a plate 718 which bears upon a heavy coil spring 720. The lower end of the spring 720 bears upon a plate 722 whose lower surface 724 has an area of one square inch. A scale 726 enables the user to read the applied force (which is equal to the pressure applied to the stack of samples through the one-square-inch lower surface 724).

The stack 750 of samples is placed between lower surface 724 and the frame bottom 728. The knob 712 is tightened until the scale 726 reads the desired force of 100 lbf (100 psi applied to the samples). The entire device 700 including samples is then placed in an oven at 50° C. for 24 hours. The device 700 is then removed from the test environment and cooled to room temperature. The pressure is then released and the samples removed from the device.

The samples were evaluated for tackiness and blocking by separating each pair of paperboard sheets. The results were reported as shown in Table 2, with a 0 rating indicating no tendency to blocking.

Blocking damage is visible as fiber tear, which if present usually occurs with fibers pulling up from the non-barrier surface of samples 754. If the non-barrier surface was coated with a print coating, then blocking might also be evinced by damage to the print coating.

For example, in as symbolically depicted in FIG. 5, samples 752(0)/754(0) might be representative of a "0" blocking (no blocking). The circular shape in the samples indicates an approximate area that was under pressure, for instance about one square inch of the overall sample. Samples 752(3)/754(3) might be representative of a "3" blocking rating, with up to 25% fiber tear in the area that was under pressure, particularly in the uncoated surface of sample 754(3). Samples 752(4)/754(4) might be representative of a "4" blocking rating with more than 25% fiber tear, particularly in the uncoated surface of sample 754(4). The depictions in FIG. 5 are only meant to approximately suggest the percent damage to such test samples, rather than showing a realistic appearance of the samples.

Repulpability was tested using an AMC Maelstom repulper. 110 grams of coated paperboard, cut into 1"×1" squares, was added to the repulper containing 2895 grams of water (pH of 6.5±0.5, 50° C.), soaked for 15 minutes, and then repulped for 30 minutes. 300 mL of the repulped slurry was then screened through a Vibrating Flat Screen (0.006" slot size). Rejects (caught by the screen) and fiber accepts were collected, dried and weighed. The percentage of accepts was calculated based on the weights of accepts and rejects, with 100% being complete repulpability.

As an example of poor repulpability, SBS paperboard coated with low density polyethylene (LDPE) at a coat weight of 7-11 lbs per 3000 $ft^2$ was tested and gave fiber accepts in a range of 91 to 97%. (A fiber accepts percentage close to 100% is desired). Paperboard coated with polyethylene not easily repulpable and recyclable.

Various coating formulations shown in Table 1 were applied as single layers onto a paperboard substrate, using a range of coat weights, and the results are shown in Table 3 including repulpability and compostability. All of the samples were fully repulpable. As for compostability, as seen in the first two columns of Table 3, paperboard C1 with coating using a pure styrene acrylate (SA) binder did not meet the definition of compostable at coat weights of 9-10 pounds. Furthermore these C1 samples blocked slightly, whereas the other samples did not. The next two columns show that paperboard C2 with coating using a Basonal® X 400 AL binder (made by BASF Corporation) met the definition of compostability at a coat weight of 8 pounds, but not at a coat weight of 9 pounds. The last four columns (paperboard CF1, CF2, CF3, CF4) are for coatings blending the Basonal® binder with Pen-Cote® D, a modified starch made by Ingredion Incorporated. These paperboards all meet the compostability definition.

Also included in Table 3 are measurements of Gloss, Brightness, Whiteness, and L-a-b Color. Gloss was measured on a Technidyne Model T 480A Glossmeter according to TAPPI standard T480. (GE) Brightness was measured on a Technidyne Brightimeter Micro S-5 according to TAPPI standard T452. (CIE) Whiteness was measured the Technidyne Brightimeter Micro S-5 according to TAPPI standard T562. L-a-b color was measured on the Technidyne Brightimeter Micro S-5 according to TAPPI standard T524. Using Basonal® binder or a blend of Basonal® binder with Pen-Cote® D starch showed similar or slightly higher gloss of the coating than using SA binder, but with slightly lower brightness and whiteness and slightly higher b-color value. Barrier properties are the focus of the inventive coatings, however, if there is a need to adjust the color or shade, food contact compliant dyes can be used in the formulations.

Another experiment was done by applying the CF3 formulation in two passes on a blade coater, with the first layer coat weight of 5.7 lb/3 msf and the second layer coat weight of 3.0 lb/3 msf, resulting a total coat weight of only 8.7 lb/3 msf, which met the composition requirement for compostability standard and showed a 3M kit value of 6.0. As shown from Table 4, a kit level of 5.2 was obtained when a single layer of CF3 was applied with a higher coat weight of 9.7 lb/3 msf. These results demonstrated that enhanced barrier properties can be obtained with two passes of the barrier formulations.

The Basonal® X 400 AL binder made by BASF Corporation contains about 30% natural polymer component. A natural polymer component refers to one grown and found in nature, which for example, can be any protein or polysaccharide or their derivatives. The idea of using the Basonal® X 400 AL binder along with some additional natural polymer (such as starch) in the present invention was that the natural component in the Basonal® binder would promote the compatibility of the additional starch with the Basonal® binder. Compatibility of the different ingredients is important for a barrier coating. To prove the concept, additional tests were run as shown in Table 4 to compare SA binder (PHOPLEX® C-340 from Dow Chemical Company used in the examples) and Basonal® X 400 AL (from BASF Corporation), both including Pen-Cote® D starch in the formulations at a same blend ratio. All of the samples were fully repulpable and non-blocking. As for compostability, as seen in the first three columns of Table 4, paperboard C3 with coating using a styrene acrylate (SA)/Pen-Cote® D binder did not meet the definition of compostability at coat weights of 8-12 pounds. The next three columns show that paperboard CF3 with coating using a Basonal® binder and Pen-Cote® D met the definition of compostability at a coat weight of 8.0 and 9.7 pounds, but not at a high coat weight of 10.8 pounds. Most interestingly, the CF3 (Basonal®+ Pen-Cote® D) coatings had better OGR and moisture vapor barrier performance, in other words, higher 3M kit and lower Oil Cobb values, lower WVTR values, and approximately equal water Cobb values, compared to the C3 (SA+ Pen-Cote® D) coatings. Tables 3 and 4 thus show that the combined use of Pen-Cote® D specialized starch with Basonal® binder provides improved barrier performance, especially, achieving a 3M kit level of 5+, while meeting the compostability standard, being fully repulpable, and not having blocking problems.

Figure 6:
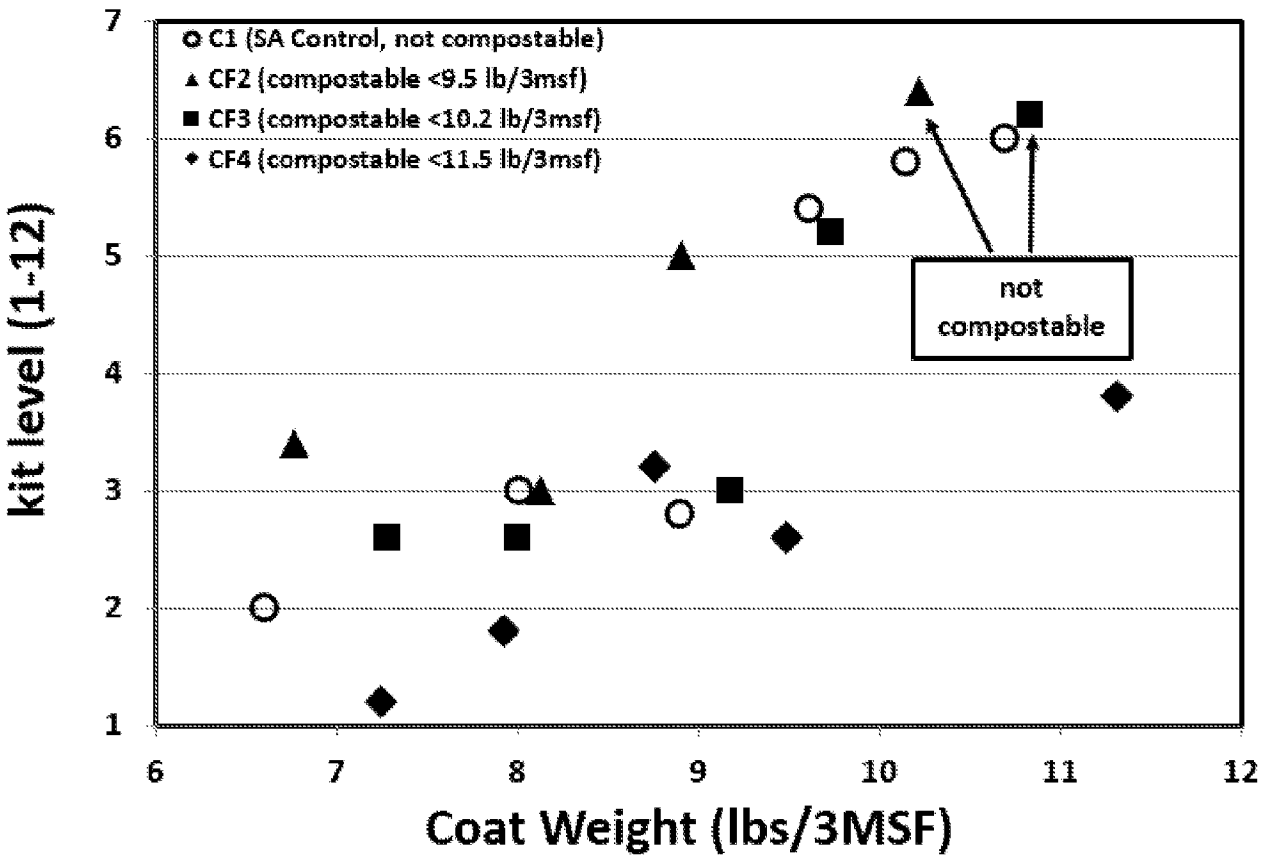
FIG. 6 is a graph of oil/grease resistance (3M kit level) vs. coat weight for several coatings.
Figure 7:
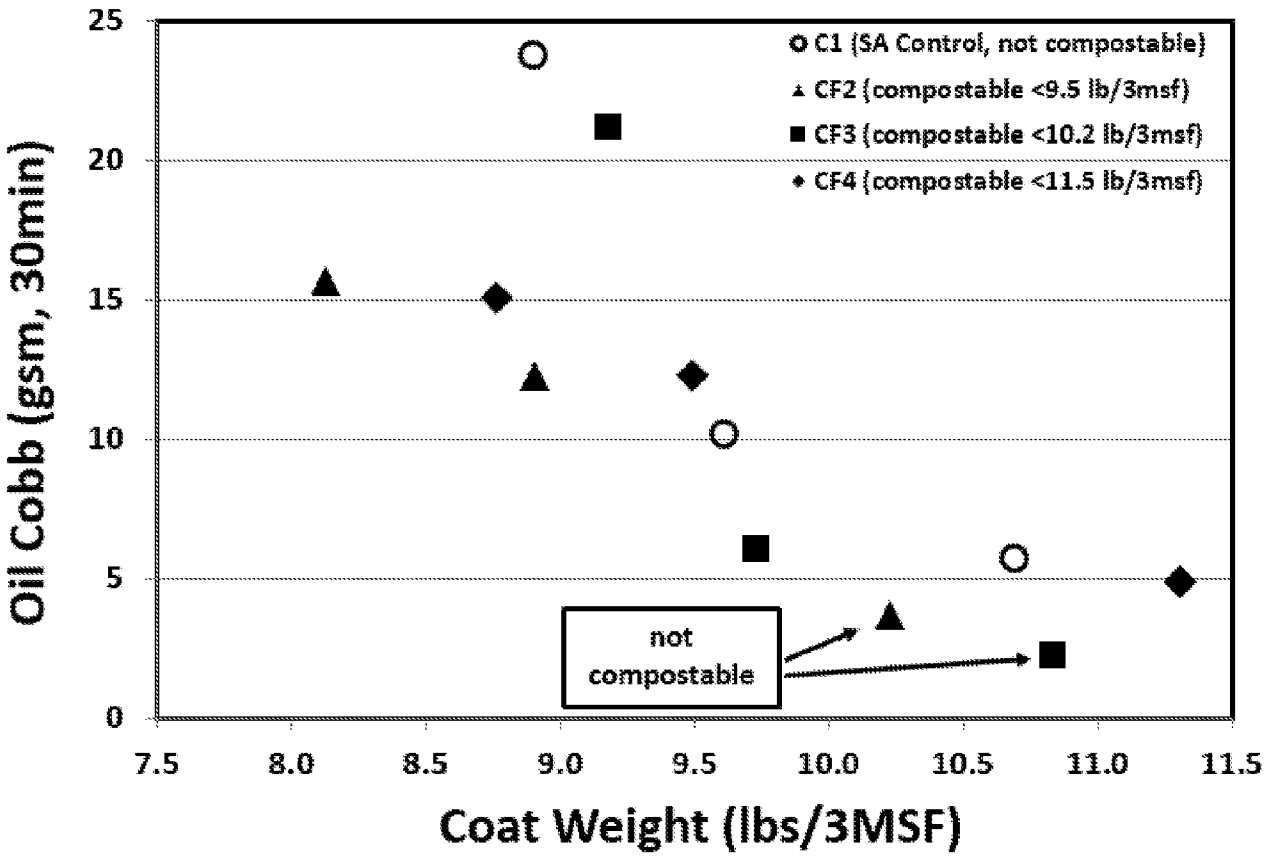
FIG. 7 is a graph of oil resistance (Cobb) vs. coat weight for several coatings.

As another way to visualize the test results, the data were plotted as shown in FIGS. 6 and 7. Some of the data on the graphs comes from Tables 3 and 4. Other data are also included. FIG. 6 shows 3M kit level vs. coat weight. The kit value generally increases (improves) as coat weight increases. None of the control samples (using SA binder) were compostable in the coat weight range of 6-12 lbs/3 msf. The samples (CF2 and CF3) using 35 parts of (combined) Basonal® X400AL binder plus Pen-Cote® D starch were compostable except at the highest coat weights (10.2 lbs for CF2 and 10.8 lbs/3 msf for CF3) and gave kit values equal to or better (higher) than the control SA sample at comparable coat weight. Samples using 30 parts of (combined) Basonal® and Pen-Cote® D were all compostable (at least up to at least 11.5 lbs/3 msf), while their kit values tended to be lower than the control and the other samples.

FIG. 7 shows oil Cobb vs. coat weight for the selected samples as in FIG. 6. The oil Cob generally decreases (improves) as coat weight increases. The compostability (or lack thereof) has already been described. The test samples using (combined) Basonal® and Pen-Cote® D gave oil Cobb tests equal or better (lower) than the test samples using styrene-acrylate binder. Most interestingly, for the samples with a total 30 parts of binder (25 parts Basonal® and 5 parts of Pen-Cote® D), although the 3M kit values were lower than the other formulations with 35 total parts of binder (as FIG. 6), the oil Cobb values were still similar or better than the control sample C1 with 35 parts of pure SA binder. This again proves the synergistic effect of Basonal® with Pen-Cote® D starch.

Some food service or food packaging applications require high quality printing on the external side of the package in addition to a barrier for the food contact side. To demonstrate that a finished paperboard with a barrier coating on one side and a print coating on the other side can meet the composition requirements for the ASTM compostability standard, another experiment was conducted to test print coat formulations that used conventional binders, styrene acrylate (PHOPLEX® C-340 used, available from Dow Chemical Company) and polyvinyl acetate (POLYCO™ 2160 used, available from Dow Chemical Company), with each polymer binder in the coatings meeting the <1% non-biodegradable composition requirement for caliper 12 pt and above, according to the compostability standard ASTM D6868-11. Although the print coat formulations for these tests were adjusted slightly by reducing the content of SA binder, the coatings still showed high quality of printability comparable to that of the commercial print grade.

The printable formulations that were tested are summarized in Table 5 for three base coatings and two top coatings described using a basis of 100 parts pigment. Table 6 shows coat weights used in several pilot coater tests for the printable formulations on 18 pt paperboard. Paperboards with the printable test coatings shown in Table 6 all would be compostable according to the ASTM standard, provided the paperboard caliper is 12 pts or higher. This would be true with—or without—the compostable barrier coatings (described above) on the opposite side of the paperboard.

Table 6 also shows the roughness, optical properties, and printability results for the test coatings. Optical properties including Gloss, Brightness, Whiteness, and L-a-b color were measured according to TAPPI standards described above. Parker Print-Surf (PPS) roughness was measured according to TAPPI standard T555. The coated samples were printed on a Harper Phantom QD™ Flexo Proofing System from Harper Corporation using a 2.5 bcm anilox roll with a blue flexo ink. The ink density was measured on an X-Rite 500 series equipment. All test coatings, which would be compostable showed higher gloss, slightly higher brightness, and comparable whiteness over the commercial control. No dyes were used in the test coatings, which in addition to variables in the formulations could contribute to the slight difference of L-a-b color values. All the test coatings showed relatively higher PPS values over the commercial control; however, they were still fairly good, and all of the test coatings after printing showed ink density slightly higher (1.64-1.72 vs. 1.62) than the commercial control, indicating the good printability of the printable test coatings. For the printability tests, a barrier coating was not applied to the opposite side of the paperboard. However, calculations show that the printable paperboard would meet the compostability standard ASTM D6868-11, whether or not the earlier-described compostable barrier coatings were used on the side opposite from the printable coating. Although two layers of printable coatings (base coat and top coat) were used in the examples, one layer of printable coating is also possible to provide fair printability and also meet the compostability standard.

In summary, the results show that compostable paperboard with full repulpability and moderate grease resistance is achieved by replacing standard binders (such as styrene acrylate) with a binder such as Basonal® X400AL in combination with small amounts of Pen-Cote® D specialized starch. In combination with conventional clay coatings that use standard binders (such as styrene acrylate and polyvinyl acetate) on the non-barrier (print) side, which also meet the <1% composition threshold for each non-biodegradable organic constituent, the entire finished paperboard product meets the composition requirements of compostability standard, at least for paperboards of caliper 12 pt and higher. The compostability standard involves calculations of how much of each non-biodegradable organic constituent is used in the product. It is hypothesized that by adjusting the coating, or the paperboard basis weight, compostability according to the ASTM standard might be achieved with somewhat lower calipers, such as 10 pt (0.010").

The tests described above used a blade coater to apply coating. As previously discussed, various types of coating devices may be used.

Once given the above disclosure, many other features, modifications or improvements will become apparent to the skilled artisan. Such features, modifications or improvements are, therefore, considered to be a part of this invention, the scope of which is to be determined by the following claims.

While preferred embodiments of the invention have been described and illustrated, it should be apparent that many modifications to the embodiments and implementations of the invention can be made without departing from the spirit or scope of the invention. It is to be understood therefore that the invention is not limited to the particular embodiments disclosed (or apparent from the disclosure) herein, but only limited by the claims appended hereto.

TABLE 1

Coating Formulations

| | Designation | | | | | | |
|---|---|---|---|---|---|---|---|
| | C1 | C2 | C3 | CF1 | CF2 | CF3 | CF4 |
| Clay-1 | 25 | 25 | 25 | 25 | 25 | 25 | 25 |
| Clay-2 | 50 | 50 | 50 | 50 | 50 | 50 | 50 |
| $CaCO_3$-1 | 25 | 25 | 25 | 25 | 25 | 25 | 25 |
| PHOPLEX ® C-340(SA) | 35 | | 30 | | | | |
| Basonal ® X400AL | | 35 | | 33 | 32 | 30 | 25 |
| Pen-cote ® D UHV (starch) | | | 5 | 2 | 3 | 5 | 5 |
| binder/pigment ratio | 35/100 | 35/100 | 35/100 | 35/100 | 35/100 | 35/100 | 30/100 |

TABLE 2

Blocking Ratings

0 = samples fall apart without any force applied
1 = samples have a light tackiness but separate without fiber tear
2 = samples have a high tackiness but separate without fiber tear
3 = samples are sticky and up to 25% fiber tear or coat damage (area basis)
4 = samples have more than 25% fiber tear or coat damage (area basis)

TABLE 3

Effect of Various Binders on Coating Properties including Compostability

| | Designation | | | | | | | |
|---|---|---|---|---|---|---|---|---|
| | C1 SA | | C2 Basonal ® | | CF1 Basonal + Pen-cote D | CF2 Basonal + Pen-cote D | CF3 Basonal + Pen-cote D | CF4 Basonal + Pen-cote D |
| Coat wt lb/3 msf | 8.9 | 9.6 | 8.1 | 9.0 | 8.4 | 8.9 | 9.7 | 11.3 |
| Compostable * | No | No | Yes | No | Yes | Yes | Yes | Yes |
| Repulp % accepts | — | 100 | — | 100 | 100 | 100 | 100 | — |
| 3M kit | 2.8 | 5.4 | 3.6 | 4.6 | 4.0 | 5.0 | 5.2 | 3.8 |
| Oil Cobb grams/(m2 30 min) | 23.7 | 10.2 | 17.5 | 9.4 | 11.3 | 12.3 | 6.1 | 4.9 |
| H2O Cobb grams/(m2 2 min) | 30.2 | 30.3 | 32.9 | 32.4 | 31.2 | 30.3 | 29.8 | 30.9 |
| WVTR grams/(m2 day) | 891 | 764 | 829 | 758 | 773 | 839 | 790 | 909 |
| Blocking | 1 | 1 | 0 | 0 | 0 | 0 | 0 | 0 |
| Gloss | 13.5 | 14.0 | — | 13.8 | — | 14.5 | 16.0 | 16.6 |
| Brightness | 79.5 | 79.4 | — | 76.2 | — | 76.1 | 75.5 | 76.3 |
| Whiteness | 66.8 | 66.3 | — | 58.2 | — | 57.9 | 56.3 | 57.8 |
| L-a-b | 91.0 | 91.9 | — | 91.2 | — | 90.1 | 90.0 | 90.3 |
| Color | 0.4 | 0.4 | | 0.2 | | 0.2 | 0.2 | 0.2 |
| | 3.4 | 3.5 | | 4.8 | | 4.9 | 5.1 | 5.0 |

* Compostable: defined as less than 1% by weight of non-biodegradable constituent for paperboard calipers of 12 points or higher

TABLE 4

Biodegradability with SA & Basonal ® (Pen-cote ® D added to both

| | Designation | | | | | |
|---|---|---|---|---|---|---|
| | C3 SA + Pen-cote ® D | | | CF3 Basonal ® + Pen-cote ® D | | |
| Coat wt lb/3 msf | 8.3 | 10.1 | 11.6 | 8.0 | 9.7 | 10.8 |
| Compostable | No | No | No | Yes | Yes | No |
| Repulp % accepts | — | 100 | 100 | — | 100 | 100 |
| 3M kit | 1.2 | 1.8 | 2.8 | 2.6 | 5.2 | 6.2 |
| Oil Cobb grams/(m2 30 min) | 46.5 | 14.9 | 6.1 | 45.5 | 6.1 | 2.3 |
| H2O Cobb grams/(m2 2 min) | — | 26.6 | 28.4 | 31.1 | 29.8 | 31.3 |
| WVTR grams/(m2 day) | — | 915 | 930 | 959 | 790 | 680 |
| Blocking | 0 | 0 | 0 | 0 | 0 | 0 |

TABLE 5

Formulations for Printable Coatings

| Designation | BC1 | BC2 | BC3 | TC1 | TC2 |
|---|---|---|---|---|---|
| Clay-1 | | | | 51 | 30 |
| Clay-2 | 50 | | | | |
| $CaCO_3$-1 | 50 | 100 | 100 | | |
| $CaCO_3$-2 | | | | 49 | 70 |
| PHOPLEX ® C-340 (SA) | 19 | 17 | 17 | 4 | 5 |
| POLYCO ™ 2160 (PVAc) | 6 | 4 | | 12 | 11 |
| Pen-cote ® D UHV (starch) | | | 4 | | |

TABLE 6

Printability Tests on Printable Coatings (18 pt paperboard; no barrier coating on opposite side)

| | Designation | | | | | |
|---|---|---|---|---|---|---|
| | Commercial Control | BC1/TC1 | BC2/TC1 | BC2/TC2 | BC3/TC1 | BC3/TC2 |
| BC Coat wt lb/3 msf | 9.4 | 8.8 | 7.5 | 7.5 | 6.2 | 6.4 |
| TC Coat wt lb/3 msf | 4.7 | 5.4 | 7.2 | 7.1 | 7.1 | 7.6 |
| Compostable * | No | Yes | Yes | Yes | Yes | Yes |
| Parker PrintSurf | 1.47 | 1.50 | 1.80 | 1.94 | 1.82 | 1.87 |
| Gloss | 46.6 | 56.4 | 57.1 | 52.2 | 57.5 | 51.1 |
| Brightness | 83.5 | 84.6 | 84.9 | 85.5 | 85.0 | 85.5 |
| Whiteness | 77.4 | 75.9 | 77.0 | 78.6 | 77.3 | 78.8 |
| L-a-b | 92.0 | 93.2 | 93.2 | 93.3 | 93.2 | 93.3 |
| Color | −0.4 | 0.4 | 0.5 | 0.5 | 0.4 | 0.5 |
| | 1.6 | 2.4 | 2.2 | 1.8 | 2.1 | 1.8 |
| Ink Density | 1.62 | 1.64 | 1.71 | 1.72 | 1.71 | 1.71 |

(* Compostable: defined as less than 1% by weight of non-biodegradable constituent for paperboard calipers of 12 points or higher)

The invention claimed is:

1. A coated paperboard comprising:

a paperboard substrate having a first side and a second side;

a first coating in contact with the first side, the first coating having a coat weight from 5 to 12 lbs per 3000 $ft^2$ and comprising binder and pigment, the first coating containing substantially no fluorochemical or wax;

a second coating in contact with the second side, wherein the second coating is a printable coating;

wherein the coated paperboard has a caliper of at least 0.010";

wherein the coated paperboard provides barrier properties to at least one of oil, grease, and moisture;

wherein the coated paperboard is compostable according to the ASTM D6868-11 standard for compostability; and wherein the coated paperboard is at least 99% repulpable.

2. The coated paperboard of claim 1, wherein the coated paperboard has a caliper of at least 0.012".

3. The coated paperboard of claim 1, wherein the binder to pigment ratio in the coating is between 25 to 40 parts binder per 100 parts pigment, by weight.

4. The coated paperboard of claim 3, wherein the binder to pigment ratio in the coating is between 30 to 35 parts binder per 100 parts pigment, by weight.

5. The coated paperboard of claim 1, wherein the binder comprises a synthetic polymer including (i) a non-biodegradable component and (ii) a natural biodegradable component.

6. The coated paperboard of claim 5, wherein the binder further comprises (iii) an additional natural biodegradable component.

7. The coated paperboard of claim 6, wherein the additional biodegradable component (iii) is at least one of polysaccharide and protein.

8. The coated paperboard of claim 6, wherein the additional biodegradable component (iii) comprises between 1 to 7 parts starch per 100 parts pigment, by weight.

9. The coated paperboard of claim 1, wherein the 3M kit test value is at least 3.

10. The coated paperboard of claim 1, wherein the coated paperboard has a 30-minute oil Cobb test of at most 20 grams per square meter.

11. The coated paperboard of claim 1, wherein the coated paperboard is repulpable to the extent that after repulping the percentage accepts is at least 99%.

12. The coated paperboard of claim 11, wherein the percentage accepts is at least 99.9%.

13. The coated paperboard of claim 1, wherein the coating weight is 5 to 12 lbs per 3000 $ft^2$.

14. The coated paperboard of claim 13, wherein the coating is applied in two passes for a total coat weight of 5 to 12 lbs per 3000 $ft^2$.

15. The coated paperboard of claim 1, having no tendency toward blocking after being held for 24 hours at 50° C. at a pressure of 100 psi.

16. The coated paperboard of claim 1, wherein the pigment comprises at least one of a clay and calcium carbonate.

17. A method of treating paperboard, the method comprising:

providing a paperboard substrate having a first side and a second side;

applying to the first side a coating comprising binder and pigment, and containing substantially no fluorochemical or wax;

applying to the second side a printable coating;

wherein the binder comprises starch;

wherein the treated paperboard has a caliper of at least 0.010";

wherein the treated paperboard is compostable according to the ASTM D6868-11 standard for compostability;

wherein the treated paperboard has a 3M kit test value of at least 3; and wherein the treated paperboard is repulpable to the extent that after repulping the percentage accepts is at least 99%.

18. The method of claim 17, wherein the coating is applied by a device selected from the group consisting of a blade coater, curtain coater, air knife coater, rod coater, film coater, short-dwell coater, spray coater, and metering film size press.

19. A coated paperboard comprising:

a paperboard substrate;

a base coating in contact with the paperboard substrate, the base coating having a coat weight from 6 to 10 lbs per 3000 $ft^2$ and comprising binder and pigment;

a top coating in contact with the base coating, the top coating having a coat weight from 4 to 7 lbs per 3000 $ft^2$ and comprising binder and pigment;

wherein the coated paperboard has a caliper of at least 0.010"; and wherein the coated paperboard is compostable according to the ASTM D6868-11 standard for compostability.

* * * * *